US007992475B2

(12) United States Patent
Buettner

(10) Patent No.: US 7,992,475 B2
(45) Date of Patent: Aug. 9, 2011

(54) PLATE WORKPIECE PROCESSING

(75) Inventor: Stefan Buettner, Markgroeningen (DE)

(73) Assignee: TRUMPF Werkzeugmaschinen GmbH + Co. KG, Ditzingen (DE)

( * ) Notice: Subject to any disclaimer, the term of this patent is extended or adjusted under 35 U.S.C. 154(b) by 0 days.

(21) Appl. No.: 12/428,748

(22) Filed: Apr. 23, 2009

(65) Prior Publication Data

US 2009/0223334 A1 Sep. 10, 2009

Related U.S. Application Data

(63) Continuation of application No. PCT/EP2007/008720, filed on Oct. 9, 2007.

(30) Foreign Application Priority Data

Oct. 24, 2006 (DE) ..... 10 2006 050 018

(51) Int. Cl.
*B26D 5/00* (2006.01)

(52) U.S. Cl. ..... 83/25; 219/121.72; 83/686

(58) Field of Classification Search ..... 83/25, 108, 83/940, 27, 32, 686; 219/121.72
See application file for complete search history.

(56) References Cited

U.S. PATENT DOCUMENTS 3,979,984 A * 9/1976 Daniels ..... 83/410
4,546,683 A * 10/1985 Volkel et al. ..... 83/27
5,088,181 A * 2/1992 Jeppsson ..... 29/563
5,862,579 A 1/1999 Blumberg
6,957,486 B2 10/2005 Fritz
7,011,007 B2 * 3/2006 Stein ..... 83/552

FOREIGN PATENT DOCUMENTS

| | | |
|---|---|---|
| DE | 3246119 | 1/1984 |
| DE | 3311593 | 1/1984 |
| DE | 3832215 | 3/1990 |
| DE | 10208297 | 8/2003 |
| EP | 1 166 915 | 1/2002 |
| EP | 1 201 330 | 5/2002 |
| JP | 60184430 | 9/1985 |

(Continued)

OTHER PUBLICATIONS

International Search Report for corresponding PCT Application No. PCT/EP2007/008720, mailed Feb. 14, 2008, 9 pages.

(Continued)

*Primary Examiner* — Kenneth E. Peterson
(74) *Attorney, Agent, or Firm* — Fish & Richardson P.C.

(57) ABSTRACT

A plate workpiece processing method includes utilizing one or more cutting devices of a machine tool to perform first and second cutting operations on a plate workpiece. During the first cutting operation, the workpiece is moved relative to cutting device(s) used for the first cutting operation, at least two cut-outs are partially formed in the workpiece with only a common residual connection left that jointly connects the partially formed cut-outs to a remaining portion of the workpiece and that is shortened along one or more cutting lines of the second cutting operation to a size that is larger than a working area of the cutting device(s) used for the second cutting operation. During the second cutting operation, the workpiece is maintained stationary supported by the machine tool, the shortened common residual connection is severed along the cutting line(s) to completely separate the cut-outs from the remaining portion of the workpiece.

10 Claims, 3 Drawing Sheets

FOREIGN PATENT DOCUMENTS

| | | |
|---|---|---|
| WO | WO 84/03647 | 9/1984 |

OTHER PUBLICATIONS

International Preliminary Report on Patentability from corresponding PCT Application No. PCT/EP2007/008720, mailed Apr. 28, 2009, with English translation mailed May 5, 2009, 12 pages total .

Office Action from corresponding Chinese Application No. 200780039680.6, mailed Jul. 30, 2010, with English translation, 5 pages.

Office Action from corresponding Chinese Application No. 200780039680.6, mailed Jan. 11, 2011, with English translation, 6 pages.

* cited by examiner

PLATE WORKPIECE PROCESSING

CROSS REFERENCE TO RELATED APPLICATIONS

This application is a continuation of and claims priority under 35 U.S.C. §120 to PCT Application No. PCT/EP2007/008720, filed on Oct. 9, 2007, which claimed priority to German Application No. DE 10 2006 050 018.0, filed on Oct. 24, 2006. The contents of both of these priority applications are hereby incorporated by reference in their entirety.

TECHNICAL FIELD

The invention relates to processes for obtaining at least two workpiece cut-outs from a plate workpiece, such as a sheet metal panel.

BACKGROUND

One known method for obtaining sheet metal cut-outs from a sheet metal panel is described in DE-C-38 32 215. In the known method, a plurality of severing cuts are made in a sheet metal panel using a punching and nibbling device. For that purpose, the sheet metal panel in question is moved relative to the punching and nibbling device by a panel handling device. The severing cuts partially sever the connection between a plurality of sheet metal cut-outs and a remaining workpiece. Each of the partially cut-free sheet metal cut-outs is connected to the remaining workpiece by its own residual connection exclusive to that sheet metal cut-out. For final cutting-free of the sheet metal cut-outs, the sheet metal panel is fed to a plate shear. The maximum cutting length of the plate shear corresponds to at least the length or width of the sheet metal panel to be processed.

The plate shear then makes in the stationary sheet metal panel a final severing cut which extends over the entire width or length of the sheet metal panel. A plurality of sheet metal cut-outs connected to the remaining workpiece along the cutting line of the final severing cut are consequently entirely severed from the remaining workpiece. The sheet metal cut-outs cut free in that manner then slide onto a conveyor belt for removal.

Another method of processing sheet metal panels is known from EP 1 166 915 A2. In that method, the sheet metal panels are stationary during processing. That method is used to produce gasket plates that are to be cut from sheet metal unrolled from a coil. For that purpose, the sheet metal is successively subjected in a follow-on composite tool to a cutting-free process (preparatory severance cutting) and a severing process (final severance cutting). In one variant of the method, a plurality of gasket plates are obtained simultaneously (see, e.g., EP 1 166 915 A2, FIG. 8). In that variant, a portion of sheet metal from which two gasket plates are ultimately produced is first provided at a cutting-free station with lateral cut-outs lying opposite each other. A residual connection of the sheet metal portions to the remaining workpiece remains between the lateral cut-outs. At that point in time, the two gasket plates to be obtained from the sheet metal portion have not yet been severed from each other. Severing of the gasket plates from each other and also severing thereof from the remaining workpiece takes place in the final severing process which follows the lateral cutting-free of the sheet metal portion.

SUMMARY

In general, this invention relates to processes for obtaining at least two workpiece cut-outs from a plate workpiece, such as a sheet metal panel.

One aspect of the invention provides a plate workpiece processing method for obtaining at least two workpiece cut-outs from a plate workpiece. The method includes utilizing one or more cutting devices of a machine tool to perform a first cutting operation and a second cutting operation on a plate workpiece. During the first cutting operation, with the plate workpiece moving relative to the cutting device or cutting devices used for the first cutting operation, at least two workpiece cut-outs are partially formed in the plate workpiece with only a common residual connection being left that jointly connects the partially formed workpiece cut-outs to a remaining portion of the plate workpiece and that is shortened along one or more cutting lines of the second cutting operation to a size that fits within a working area of the cutting device or cutting devices used for the second cutting operation. During the second cutting operation, with the plate workpiece being maintained stationary relative to a workpiece support of the machine tool, the shortened common residual connection is severed, via the cutting device or cutting devices used for the second cutting operation, along the one or more cutting lines of the second cutting operation to completely separate the workpiece cut-outs from the remaining portion of the plate workpiece.

In some embodiment, the second cutting operation includes severing the shortened residual connection along the one or more cutting lines such that the workpiece cut-outs are separated from the remaining portion of the plate workpiece simultaneously.

In certain embodiments, the workpiece cut-outs are removed from the remaining portion of the plate workpiece by gravity after the second cutting operation.

In some embodiments, at least one of the first and second cutting operations includes punching and/or laser cutting.

In certain embodiments, the first cutting operation and the second cutting operation are performed with the same cutting device.

In some embodiments, the first cutting operation includes cutting the common residual connection along a plurality of cutting lines to form the shortened residual, and the second cutting operating comprises cutting the shortened residual connection along the plurality of cutting lines to separate the workpiece cut-outs from the remaining portion of the plate workpiece. In some cases, the cutting lines extend in different directions.

In certain embodiments, during the second cutting operation, the workpiece cut-outs are disposed over an opening in a workpiece table supporting the plate workpiece.

In some embodiments, the first cutting operation includes partially forming the workpiece cut-outs in the plate workpiece such that the partially formed workpiece cut-outs remain surrounded by the remaining portion of the plate workpiece.

In certain embodiments, the shortened residual connection is in the form of a web connecting the partially formed workpiece cut-outs and the remaining portion of the plate workpiece.

In some embodiments, the second cutting operation includes cutting the web such that the workpiece cut-outs are separated from the remainder of the plate workpiece simultaneously.

In certain embodiments, the first cutting operation includes partially forming the workpiece cut-outs in the plate workpiece such that the partially formed workpiece cut-outs remain connected to the remaining portion of the plate workpiece by the common residual connection.

Another aspect of the invention features a plate workpiece processing method for obtaining at least two workpiece cut-outs from a plate workpiece. The method includes utilizing a first one of one or more cutting devices to perform a first cutting operation, in which a common residual connection, connecting at least two partially formed workpiece cut-outs to a remaining portion of a plate workpiece, is cut along one or more cutting lines to form a shortened residual connection that is sized to fit within a working area of the first one of the cutting devices. The method also includes performing a second cutting operating, using the first one of the cutting devices, in which the shortened residual connection is severed along the one or more cutting lines to separate the workpiece cut-outs from the remaining portion of the plate workpiece.

In some embodiments, the second cutting operation includes severing the shortened residual connection along the one or more cutting lines such that the workpiece cut-outs are separated from the remaining portion of the plate workpiece simultaneously.

In certain embodiments, at least one the first and second cutting operations includes punching and at least one of the first and third cutting operations includes laser cutting.

In some embodiments, the first cutting operation and the second cutting operation are performed with the same cutting device.

In certain embodiments, the first cutting operation is performed while the plate workpiece is moved relative to the cutting devices.

Another aspect of the invention provides a plate workpiece processing method for obtaining at least two workpiece cut-outs from a plate workpiece. The method includes utilizing at least one of one or more cutting devices to partially form at least two workpiece cut-outs in a plate workpiece such that the workpiece cut-outs remain connected to a remaining portion of the plate workpiece by a common residual connection, and utilizing a first one of the cutting devices to cut the common residual connection along one or more cutting lines to form a shortened residual connection that is sized to fit within a working area of the first one of the cutting devices. The method also includes utilizing the first one of the cutting devices to sever the shortened residual connection along the one or more cutting lines such that the at least two cut-outs are separated from the remainder of the plate workpiece simultaneously.

In some embodiments, the cut-outs are removed from the remainder of the plate workpiece by gravity after the shortened residual connection is severed.

In certain embodiments, the remaining portion of the plate workpiece is stationary while the shortened residual connection is severed.

In another aspect of the invention, a preparatory severance cutting operation is performed in which a residual connection between two or more workpiece cut-outs and a remaining portion of a plate workpiece is shortened along cutting line(s). That shortening is dimensioned such that the resulting, shortened residual connection is sized to fit within the working area of a cutting device for a final severance cutting. In that manner it is possible to process workpieces that are larger than the working area of the cutting device for the final severance cutting. Consequently, the method may be performed using conventional machine tools in which the cutting devices used for the final severance cutting have a working area that is smaller than the workpiece to be processed.

In some embodiments, the shortened residual connection is severed along the cutting line(s) during the final severance cutting such that the cut-outs are separated from the remaining portion of the plate workpiece simultaneously. For example, simultaneous severance can be performed via a single punching stroke of a punch. This avoids a situation where a workpiece cut-out that has already been separated from the remaining portion of the plate workpiece shifts relative remaining portion of the plate workpiece while a further workpiece cut-out is being cut free.

In certain embodiments, the workpiece cut-outs that have been separated from the remaining portion of the plate workpiece are further removed from the remaining portion of the plate workpiece under gravity. Accordingly, the workpiece cut-outs fall or slide, away from the remaining portion of the plate workpiece, in a discharge direction. This can help to reduce the need for complex handling devices to handle the separated workpiece cut-outs.

In some embodiments, the final severance cutting is performed by punch cutting and/or laser cutting.

In certain embodiments, the preparatory severance cuffing and the final severance cutting are performed with the same cutting device. As a result, additional transfer of the workpiece between the preparatory and the final severance cutting can be reduced. An apparatus (e.g., machine tool) for carrying out the method may possibly require only a single cutting device.

In some embodiments, the shortened residual connection between the workpiece cut-outs and the remaining portion of the plate workpiece is severed by the final severance cutting along cutting lines that are not arranged as a linear continuation of one another. Since cuts extending in different directions may be made, the workpiece cut-outs that are to be cut free together may be arranged relative to one another in a flexible manner.

In certain embodiments, in the final severance cutting operation the workpiece cut-outs are disposed over an opening in a workpiece table supporting the plate workpiece. Rapid and reliable removal of the workpiece cut-outs is thereby made possible.

In some embodiments, the common residual connection between the workpiece cut-outs and the remaining portion of the plate workpiece is cut free by the preparatory severance cutting in such a manner that the workpiece cut-outs remain surrounded by the remaining portion of the plate workpiece. The remaining portion of the plate workpiece therefore surrounds the workpiece cut-outs like a frame. This can help to provide for an increased stability against deformation. Such deformation may lead to collisions between the remaining portion of the plate workpiece and parts of the machine tool. As a result of the increased stability of the remaining portion of the plate workpiece such collisions are reduced or avoided.

In certain embodiments, the shortened residual connection between the workpiece cut-outs and the remaining portion of the plate workpiece is in the form of a common connecting web. By cutting-free of the common connecting web the workpiece cut-outs are cut completely free from the remaining portion of the plate workpiece simultaneously. The workpiece cut-outs cut free in that manner are removed from the remaining portion of the plate workpiece simultaneously.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 3:
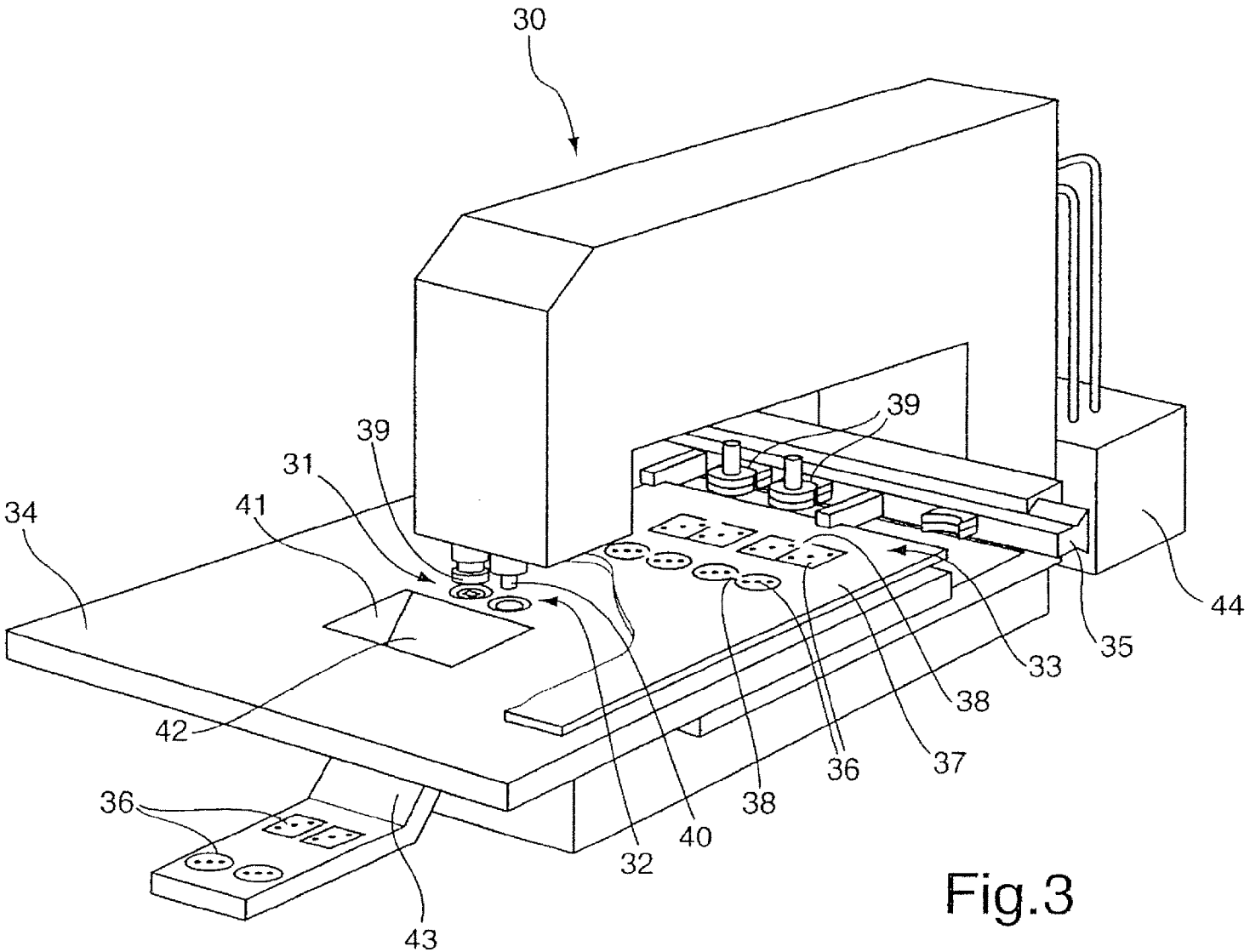
FIG. 3 is a perspective view of a laser punch press for obtaining sheet metal cut-outs from a sheet metal panel.

FIGS. 1*a* to 1*d* illustrate a plate workpiece in the form of a sheet metal panel 1 as two workpiece cut-outs, more specifically two sheet metal cut-outs 2, are being obtained. A machine tool as shown in FIG. 3 and as described in detail hereinafter is used to carry out the method.

Figure 1A:
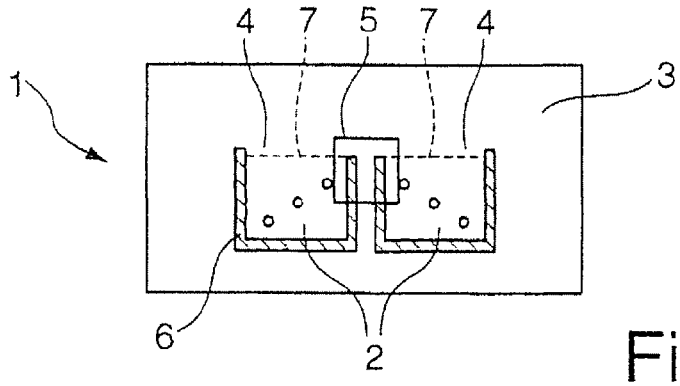
FIGS. 1*a* to 1*d* show a first sheet metal panel at different points in time in the course of a method for obtaining two sheet metal cut-outs.

FIG. 1*a* shows the sheet metal panel 1 during a preparatory severance cutting. The preparatory severance cutting is performed with the sheet metal panel moving.

At the point in time illustrated, the two sheet metal cut-outs 2, each of which has three smaller punched holes, are still connected to the remaining portion of the workpiece 3 by a common residual connection 4. A cutting device of the machine tool used has a working area 5.

Apart from in the region of the common residual connection 4, the sheet metal cut-outs 2 have been severed from the sheet metal panel 1 by severing cuts 6 made by the cutting device. As shown in FIG. 1*a*, the common residual connection 4 between the two sheet metal cut-outs 2 and the remaining portion of the workpiece 3 in the direction of cutting lines 7 which are aligned with each other, i.e. that extend in the same direction, is larger than the working area 5 of the cutting device. Consequently, the common residual connection 4 cannot be completely severed from the remaining workpiece 3 while the sheet metal panel 1 is stationary.

In order to make severing cuts 6 in a region of the sheet metal panel lying outside the working area 5 in the position of the sheet metal panel 1 shown in FIG. 1*a*, the sheet metal panel 1 is moved or re-positioned relative to the cutting device in such a manner that the region of the sheet metal panel to be processed comes into the working area 5 of the cutting device.

Starting with the situation shown in FIG. 1*a*, the residual connection 4 between the sheet metal cut-outs 2 and the remaining workpiece 3 is shortened in the direction of the cutting lines 7. For that purpose, with the sheet metal panel 1 moving relative to the cutting device, the regions of the sheet metal panel to be processed are brought into the working area 5 of the cutting device. Using the cutting device, the severing cuts 6 are extended in the direction of the cutting lines 7. On completion of the preparatory severance cutting, a shortened residual connection (as shown in FIG. 1*b*) is obtained.

Figure 1B:
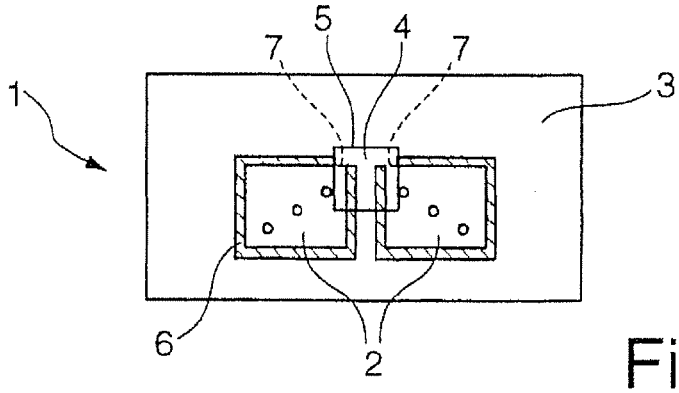

In FIG. 1*b*, the sheet metal panel 1 is shown after the preparatory severance cutting and immediately before the final severance cutting. The sheet metal cut-outs 2 are still connected to the frame-like remaining workpiece 3 surrounding them. The residual connection 4 now lies in the working area 5 of the cutting device. The subsequent, final severance cutting of the sheet metal cut-outs 2 is carried out along the cutting lines 7 with the sheet metal panel 1 stationary.

Figure 1C:
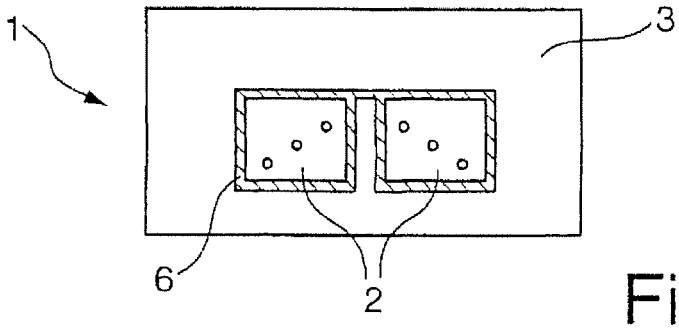
Figure 1D:
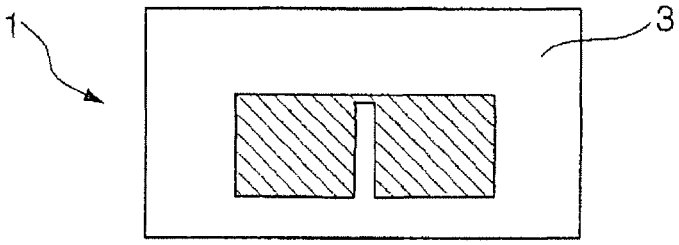

FIG. 1*c* shows the sheet metal panel 1 with sheet metal cut-outs 2 cut entirely free from the frame-like remaining portion of the workpiece 3. Starting with the situation shown in FIG. 1*c*, the cut-free sheet metal cut-outs 2 are removed from the frame-like remaining portion of the workpiece 3 simultaneously. In FIG. 1*d*, the remaining portion of the workpiece 3 is illustrated following removal of the sheet metal cut-outs 2.

The sheet metal cut-outs 2 are cut free from the remaining portion of the workpiece 3 by the final severance cutting without the sheet metal panel 1 meanwhile being moved, and at the same time are removed with the position of the sheet metal panel 1 or the remaining portion of the workpiece 3 remaining unchanged. By virtue of the fact that two sheet metal cut-outs 2 are produced together, the production time per sheet metal cut-out 2 is reduced in comparison with single-component production. Final cutting-free and removal of the sheet metal cut-outs 2 takes place while the sheet metal panel 1 is stationary in order to avoid undesirable shifting of the entirely cut-free sheet metal cut-outs 2 relative to the remaining workpiece 3.

Figure 2:
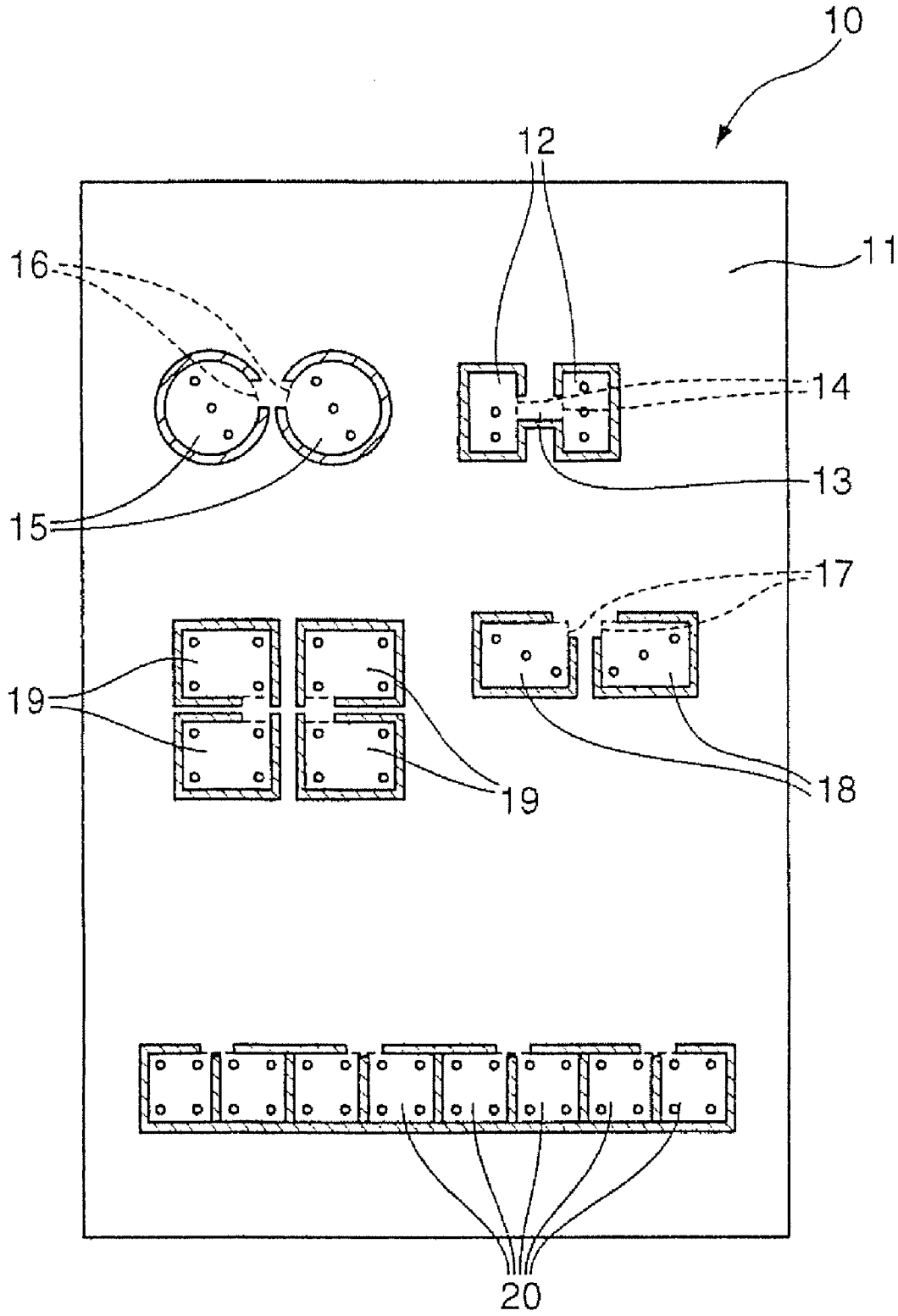
FIG. 2 shows a second sheet metal panel with sheet metal cut-outs partially cut free.

Further possible methods of cutting sheet metal cut-outs free from a sheet metal panel 10 are shown in FIG. 2. All of the sheet metal cut-outs illustrated are in the state immediately before the final severance cutting operation. They are accordingly still partly connected to the remaining portion of the workpiece 11. In the case of the sheet metal panel 10, the remaining portion of the workpiece 11 of mutually associated sheet metal cut-outs comprises not only unprocessed areas of the sheet metal panel but also other, partially cut-free sheet metal cut-outs.

Sheet metal cut-outs 12 have been cut free from the remaining portion of the workpiece 11 during the preparatory severance cutting in such a manner that they remain connected to the remaining portion of the workpiece 11 by a common connecting web 13. By final severance cutting the common connecting web 13 connecting the sheet metal cut-outs 12 to the remaining portion of the workpiece 11 is cut free via the cutting device along the cutting lines 14. In this case, the cutting lines 14 are arranged parallel to each other.

In addition to rectangular sheet metal cut-outs, sheet metal cut-outs having other contours may also be cut free. For example, this is illustrated by circular sheet metal cut-outs 15. The circular sheet metal cut-outs 15 depicted in FIG. 2 can be cut free along cutting lines 16. As shown in FIG. 2, the cutting lines 16 extend in a curve and hence extend in different directions. The same applies to cutting lines 17 of sheet metal cut-outs 18.

Referring to sheet metal cut-outs 19, it is possible to see the way in which four sheet metal cut-outs are to be cut free by preparatory severance cutting so that they may be finally cut free with the sheet metal panel 10 stationary. Sheet metal cut-outs 20 may be cut entirely free from the remaining portion of the workpiece 11 in pairs, it merely being necessary for the sheet metal panel 10 to be moved linearly in its transverse direction relative to the cutting device between the final severance cutting of one pair and that of a further pair.

In the case of the sheet metal cut-outs 12, 15, 18, 19 and 20 illustrated by way of example in FIG. 2, the sheet metal cut-outs that are cut free together are of an identical shape in each case. It is also possible in principle, however, for sheet metal cut-outs of differing shapes to be finally cut free together.

FIG. 3 shows the machine tool in the form of a laser punch press 30 on which the above-mentioned method for obtaining sheet metal cut-outs from a sheet metal panel is performed. The laser punch press 30 includes, as cutting devices, a conventional punch device 31 and a conventional laser cutting device 32. A sheet metal panel 33 is supported during workpiece processing on a workpiece table 34. Using a conventional coordinate guide 35, the sheet metal panel 33 is moved relative to the punch device 31 and the laser cutting device 32 in the plane of the sheet metal panel. By movement of the sheet metal panel 33 relative to the punch device 31 and the laser cutting device 32 the particular area of the sheet metal panel to be processed is moved into the working area of the punch device 31 or the laser cutting device 32.

First, as described above, by preparatory severance cutting, sheet metal cut-outs 36 are partially severed from a remaining portion of a workpiece 37, i.e. the connection of the sheet metal cut-outs 36 to the remaining portion of the workpiece 37 is cut free leaving a residual connection 38. The punch device 31 or alternatively or in addition the laser cutting device 32 is used for the preparatory severance cutting.

Both the punch device 31 and the laser cutting device 32 may also be used for the final severance cutting. In that case, the working area of the punch device 31 is defined by the size of punch tools 39 that are used on it. The working area of the laser cutting device 32 is essentially determined by the maximum travel distances of a movement unit, not shown in detail, of the laser cutting device 32. Using a movement unit of the laser cutting device 32, a laser cutting nozzle 40 together with a laser cutting beam is moved relative to the sheet metal panel 33 in the plane of the sheet metal panel along the cutting lines over relatively short travel distances.

For final severance cutting, the partially cut-free sheet metal cut-outs 36 are positioned relative to the punch device 31 or the laser cutting device 32 using the coordinate guide 35 such that their residual connection 38 lies in the working area of the relevant cutting device.

In the case of final severance cutting by punch-cutting, severing cuts are made by a cutting edge on a punch acting on one of the residual connections 38 in a punching stroke. In that operation, the relevant residual connection 38 is severed along all the cutting lines substantially simultaneously. In the case of punch-cutting using a cutting edge inclined in the stroke direction of the working stroke and located on a bevelled cutting punch, although the severing cut is made along all the cutting lines during a single punching stroke, the severing of the residual connection 38 between the sheet metal panel 33 and the sheet metal cut-outs 36 takes place progressively.

In the case of final severance cutting by laser cutting, a severing cut is made by continuously moving the laser cutting beam along the cutting lines using a movement unit. Consequently, comparable to punch-cutting using a bevelled cutting punch, the sheet metal panel 33 is severed at different places along the cutting lines at staggered times.

The residual connection 38 is so positioned and the sheet metal cut-outs 36 are cut free from the remaining workpiece 37 by the preparatory severance cutting in such a manner that, when their residual connection 38 lies in the working area of one of the cutting devices, the sheet metal cut-outs 36 themselves are substantially arranged over an opening 41 in the workpiece table 34.

The opening 41 may be opened and closed by a flap 42. When the flap 42 is open, the sheet metal cut-outs 36, which have been cut entirely free after the final severance cutting, fall out of the remaining workpiece 37 under gravity. The sheet metal cut-outs 36 are removed from the working area of the laser punch press 30 via the flap 42 and a chute 43. Especially rapid removal of the sheet metal cut-outs 36 is possible if the final severance cutting is performed with the flap 42 open.

As an alternative to being discharged through the opening 41 in the workpiece table 34, the cut-free sheet metal cut-outs 36 may also be taken out of the remaining workpiece 37 by handling devices, such as a suction frame. Since the final severance cutting is performed on the stationary sheet metal panel, the sheet metal cut-outs may already be fixed to the handling device before the final severance cutting. For example, immediately before the final severance cutting, suction cups of a suction frame can be applied to the sheet metal cut-outs. Reliable removal of the sheet metal cut-outs is thereby possible.

Sheet metal cut-outs that have been cut free (i.e., separated from the remaining portion of the plate workpiece) can also be removed manually. For safety reasons the machine may have to be completely stopped for each individual manual removal operation. By virtue of the fact that at least two sheet metal cut-outs are cut free and removed together, the idle times of the machine are reduced.

Regardless of the way in which the sheet metal cut-outs 36 are removed, all sheet metal cut-outs 36 cut free during a final severance cutting operation are taken out of the remaining workpiece 37 before the sheet metal panel 33 is moved again by the coordinate guide 35 for a subsequent workpiece processing operation. In that manner, undesirable shifting of the cut-free sheet metal cut-outs 36, relative to the remaining portion of the workpiece 37, is reduced or avoided.

The procedures described above taking place on the laser punch press 30 are controlled in coordination with one another via a numerical control unit 44. For that purpose, a control program stored in the numerical control unit 44 is implemented.

The control program is created with the aid of a programming system. When the control program is generated, programming software forming the basis of the programming system causes a subsequent workpiece processing operation to be performed in accordance with the above method. The programming software automatically determines and influences the relative arrangement of the sheet metal cut-outs, the severing cuts during the preparatory and final severance cutting, and the removal operation of the sheet metal cut-outs, so that sheet metal cut-outs are cut free and removed together.

A number of embodiments of the invention have been described. Nevertheless, it will be understood that various modifications may be made without departing from the spirit and scope of the invention. Accordingly, other embodiments are within the scope of the following claims.

What is claimed is:

1. A plate workpiece processing method for obtaining at least two workpiece cut-outs from a plate workpiece, the method comprising:

utilizing one or more cutting devices of a machine tool to perform a first cutting operation and a second cutting operation on a plate workpiece, wherein the cutting device or devices used for the second cutting operation are configured to perform a cutting operation with the plate workpiece being maintained stationary in a working area that is smaller than the plate workpiece, the working area being determined by a structural maximum travel limit distance of the cutting device or devices used for the second cutting operation, wherein during the first cutting operation, with the plate workpiece moving relative to the cutting device or cutting devices used for the first cutting operation, at least two workpiece cut-outs are partially formed in the plate workpiece with only connecting portions being left to connect the partially formed workpiece cut-outs to a remaining portion of the plate workpiece, the connecting portions being shortened along one or more cutting lines of the second cutting operation from a size that is larger than the working area of the cutting device or cutting devices used for the second cutting operation to a size that fits within the working area, and wherein during the second cutting operation, with the plate workpiece being maintained stationary and supported by the machine tool, the shortened connecting portions are severed, via the cutting device or cutting devices used for the second cutting operation, along the one or more cutting lines of the second cutting operation, the second cutting operation being a single continuous cutting operation to completely separate the workpiece cut-outs from the remaining portion of the plate workpiece.

2. The method of claim 1, wherein the first cutting operation comprises partially forming the workpiece cut-outs in the plate workpiece such that the partially formed workpiece cut-outs remain surrounded by the remaining portion of the plate workpiece.

3. The method of claim 1, wherein the workpiece cut-outs are removed from the remaining portion of the plate workpiece by gravity after the second cutting operation.

4. The method of claim 1, wherein the first cutting operation comprises punching.

5. The method of claim 1, wherein at least one of the first and second cutting operations comprises laser cutting.

6. The method of claim 1, wherein the first cutting operation and the second cutting operation are performed with the same cutting device.

7. The method of claim 1, wherein the first cutting operation comprises shortening the connecting portions along a plurality of cutting lines to form the shortened connecting portions, and the second cutting operation comprises severing the shortened connecting portions along the plurality of cutting lines to separate the workpiece cut-outs from the remaining portion of the plate workpiece, and wherein the cutting lines extend in different directions.

8. The method of claim 1, wherein, during the second cutting operation, the workpiece cut-outs are disposed over an opening in a workpiece table supporting the plate workpiece.

9. The method of claim 1, wherein the working area is smaller than the at least two workpiece cut-outs.

10. The method of claim 1, wherein the second cutting operation comprises laser cutting, and wherein the working area of the laser cutting device is determined by the maximum travel distances of a movement unit of the laser cutting device.

* * * * *